United States Patent [19]

Wenderott et al.

[11] 4,102,709

[45] * Jul. 25, 1978

[54] WORKABLE NICKEL ALLOY AND PROCESS FOR MAKING SAME

[75] Inventors: Berthold Wenderott; Gerhard Köhlert, both of Altena, Fed. Rep. of Germany

[73] Assignee: Vereinigte Deutsche Metallwerke AG, Frankfurt am Main, Fed. Rep. of Germany

[ * ] Notice: The portion of the term of this patent subsequent to Dec. 21, 1993, has been disclaimed.

[21] Appl. No.: 736,598

[22] Filed: Oct. 28, 1976

Related U.S. Application Data

[63] Continuation-in-part of Ser. No. 542,932, Jan. 22, 1975, Pat. No. 3,998,663.

[30] Foreign Application Priority Data

| | | | |
|---|---|---|---|
| Jan. 30, 1974 | [DE] | Fed. Rep. of Germany | 2404256 |
| May 24, 1974 | [DE] | Fed. Rep. of Germany | 2425271 |
| Aug. 9, 1974 | [DE] | Fed. Rep. of Germany | 2438381 |

[51] Int. Cl.[2] ..... C22F 1/10

[52] U.S. Cl. ..... 148/2; 29/527.7; 75/170; 148/11.5 N; 148/32

[58] Field of Search ..... 75/170, 171; 148/11.5 N, 32, 32.5, 2; 29/527.7

[56] References Cited

U.S. PATENT DOCUMENTS

| | | | |
|---|---|---|---|
| 3,622,234 | 11/1971 | Seybolt et al. | 75/171 |
| 3,749,569 | 7/1973 | Starr et al. | 75/170 |
| 3,998,663 | 12/1976 | Wenderott et al. | 148/2 |

*Primary Examiner*—R. Dean

*Attorney, Agent, or Firm*—Karl F. Ross

[57] ABSTRACT

A malleable or workable nickel composition consists of a melt containing 0.01 to 0.15% by weight oxygen, the balance nickel, which is cast into an ingot and subjected to hotforming to break up the nickel/nickel-oxide eutectic and distribute the nickel oxide in the lattice structure in finely divided form. Preferably the melt contains 0.02 to 0.12% by weight oxygen, the balance nickel.

9 Claims, 2 Drawing Figures

WORKABLE NICKEL ALLOY AND PROCESS FOR MAKING SAME

CROSS-REFERENCE TO RELATED APPLICATION

This application is a continuation-in-part of application Ser. No. 542,932 filed 22 Jan. 1975 and entitled WORKABLE NICKEL MATERIAL AND PROCESS FOR MAKING SAME, now U.S. Pat. No. 3,998,663.

FIELD OF THE INVENTION

The present invention relates to a malleable or workable nickel alloy and, more particularly, to an improved method of making a workable nickel composition.

BACKGROUND OF THE INVENTION

A workable (malleable or ductile) composition in metallurgical terms is a metal composition which can be shaped by hot or cold forming in processes other than those involving material removal. While this does not exclude material removal (milling, turning or the like) as possible shaping processes, it is well known that certain metal compositions are incapable of undergoing hot or cold forming (e.g. forging, rolling, pressing and extrusion) in a technologically effective manner and hence resort must be had to such material-removal techniques to shape such metal. Other metal compositions, however, can be rolled, pressed, forged, drawn or extruded and these are generally termed workable or malleable or ductile materials.

With nickle compositions hot-forming techniques are frequently desired and, in addition, cold-forming techniques without material removal may be advantageous.

It is known, for example, that the workability of nickel can be improved by certain procedures conventional in metallurgy. Thus, for example, a nickel melt can be degassed and oxygen can be removed by the formation of carbon monoxide by adding carbon to the melt.

The nickel oxide which is present in the melt is thereby transformed to nickel in accordance with the equation:

$$C + NiO = CO\uparrow + Ni.$$

It has been recognized that this equation does not quantitatively represent the elimination of all oxygen from a nickel melt. The equilibrium is dependent upon various parameters such as temperature and slag-forming characteristics so that almost invariably there is a high residue of oxygen in the melt or a return of oxygen to the melt.

In conventional techniques this tendency is counteracted by the addition of oxygen-scavenging elements such as magnesium, aluminum, manganese, silicon and the like, or lithium and titanium, and other elements which have a high affinity for oxygen. It is possible by adding such elements to quantitatively remove oxygen or at least preclude the presence of any nickel oxide.

However the use of these elements as scavengers for oxygen has the disadvantage that the reaction with the oxygen in the melt also can be represented by equilibria and hence the elements with high oxygen affinity must be supplied in considerable excess if an approximately complete deoxidation is to be obtained.

By contrast with the deoxidation with carbon in which the reaction product is removed as a gas, the use of oxygen-scavenging metals results in the presence in the melt and ingot of the corresponding metal oxides. Such deoxidation residues can constitute a handicap in some nickel compositions and may affect the utility of the composition for certain products and forming processes.

For example, such deoxidation residues can, depending upon the thermal conditions during use, diffuse to the surface of the body and interfere with the solderability or weldability of the product. When the nickel composition is to be used to produce parts intended for high-vacuum technology, the application of high vacuum may be detrimentally affected by the presence of such deoxidation residues.

When the nickel bodies are to be coated with glasses or enameled, still another disadvantage ensues. The contact of the deoxidation-metal oxides with elements of the coating material having a high vapor pressure (lead or zinc) results in pore formation. A similar disadvantage results from the presence of carbon residues as may occur when deoxidation is carried out with carbon monoxide formation and carbon remains in the interfacial or boundary layers of the nickel product.

Another disadvantage of nickel materials subjected to conventional deoxidation of the melt and one which is independent of the size of the ingot which is produced, is the tendency of the foreign metal oxides formed during the deoxidation process to precipitate at the grained boundaries and create loci susceptible to high corrosion and high mechanical stress, usually when the nickel bodies are brought into contact with etching alkalies at higher temperatures. Under these conditions, stress-crack corrosion develops as a major disadvantage.

OBJECT OF THE INVENTION

It is, therefore, the object of the present invention to provide a method of making a workable nickel composition in which the aforementioned disadvantages are avoided.

SUMMARY OF THE INVENTION

The present invention is based upon our surprising discovery that, as pointed out in the aforementioned copending application, a highly workable nickel composition can be obtained when a melt is formed which intentionally contains 0.01 to 0.15% oxygen in the form of a nickel/nickel oxide eutectic, the balance nickel. When this melt is cast into an ingot and the ingot is thereafter subjected to hotforming to break up the nickel/nickel oxide eutectic and bring about a fine distribution of the nickel oxide in the lattice structure of the body, the resulting product is highly workable, malleable and ductile, without the tendency to stress-crack corrosion and any of the other disadvantages enumerated above.

In other words, contrary to the conventional techniques in which deoxidation is practiced to eliminate as much of the oxygen as possible from a nickel melt, we intentionally maintain a predetermined oxygen content and indeed the aforementioned oxygen content is essential for effective production of the malleable composition.

The ingot is of course free from scavenging metals and easily volatile metals, as well as foreign oxides which are formed when scavenging metals are used in a deoxidation process. Furthermore, the melt is free from carbon and, in view of the high oxygen content (relatively), carbon cannot be present. There is no significant hydrogen present in the melt (also because of the relatively high oxygen level) in spite of the fact that hydrogen has a notoriously high solubility in molten nickel and creates significant disadvantages when present.

It has been found that, in establishing the aforementioned critical oxygen level in the melt, any hydrogen which may have been present when the nickel was melted is eliminated as water vapor and driven off in the gaseous state. Water vapor has no solubility in a nickel melt.

It has been found that best results are obtained with an oxygen level in the melt of 0.02 to 0.12% by weight oxygen. In all cases the balance is nickel.

The hotforming in accordance with the present invention is carried out at temperatures between 950° and 1150° C. Best results are obtained, in this respect, by beginning the hotforming at a temperature in the higher portion of this range, usually around 1150° C, and continuing the hotforming with decreasing temperature to below 800° C, preferably below 750° C. Most effective results have been obtained in this manner.

Practically any hotforming process may be used as long as it involves a reduction in the cross-section of the ingot. The hotforming may be carried out by hotpressing or forging but preferably is effected by hotrolling.

The nickel compositions which are produced in accordance with the invention can be fabricated into sheets, bars or rods which can be shaped by conventional techniques using hot-and coldforming. Intermediate annealing or tempering steps may also be practiced during the shaping of the product into finished bodies.

The material can be used for any purpose in which nickel compositions are now used and in which nickel compositions have hitherto been employed after preparation by conventional deoxidation of the melt.

Numerous advantages are obtained with the product of the present process. Firstly, there is a considerable saving in the cost of producing the product and greater utilization of the smelt capacity of the metallurgical plant producing same since degassing and other deoxidation techniques are completely eliminated.

Secondly, there is a significant saving in time and hence cost in producing the products according to the invention since the time from beginning of formation of the melt to completion thereof and casting into an ingot, by elimination of deoxidation processes, can be reduced practically by half.

To the extent that oxygen or deoxidation metals are unavoidably incorporated into the melt, these materials are eliminated as soon as the oxygen level is brought to about 0.01 or 0.02% by weight.

The nickel compositions according to the invention are thus free from metallic and oxidic deoxidation residues as well as from hydrogen and carbon. The disadvantages of the nickel compositions produced by conventional deoxidation techniques are therefore eliminated.

The nickel composition of the present invention can be welded without difficulty and is highly suitable for use in the fabrication of apparatus for the chemical industry. it is possible to form the weld seams of sheets of the nickel composition, on the side to which it is to be subjected to corrosive attack, by the tungsten inert gas (TIG) process, thereafter filling the balance of the weld seam with titanium containing weldment in accordance with German Industrial Standard DIN 1736.

Wire formed from the nickel compositions according to the invention can be butt-welded directly without difficulty, thereby enabling the production of continuous strands of such wire. Surprisingly, the wire can be butt-welded also to tungsten which is especially interesting for the production of incandescent lamps since tungsten, upon being welded to other materials, becomes highly brittle to the extent that these metals contain even traces to carbon.

The nickel composition of the present invention which is alloyed exclusively with oxygen, results in products having equal or superior qualities by comparison with other nickel materials. For example, the composition of the present invention has a significantly better electrical conductivity. Because of the simultaneously improved thermal resistance, the compositions of the present invention are particularly suitable for use as temperature sensors and thermoelements whereby the output against NiCr 10 wire at a temperature of about 1000° C is about 15 to 20% higher than that obtained from conventional Ni/NiCr thermocouples. This sharply increases the measurement precision.

The curve of temperature coefficient of expansion with the nickel alloy with oxygen has, in the region of 350° to 450° C, a flatter characteristic than usual LC-nickel, a considerable advantage when it is used in the construction of apparatus adapted to contain sodium hydroxide or other alkali melts. Under these conditions, the composition, being free from carbon and deoxidation residue of the type described, has a significantly improved corrosion resistance and stress-crack corrosion resistance in the aggressive media to which it may be subject.

EXAMPLE 1

A nickel melt is first analyzed and thereafter brought to a level 0.11% by weight oxygen, the balance nickel. The melt is thereafter cast into an ingot with a mean cross-section of 560 × 650 mm and a weight of about 4.5 metric tons. This ingot is then rolled into a slab of a thickness of 90 mm from a temperature of 1100° C to 790° C in a single heat. After the usual intervening treatment by milling, grinding and ultrasonic testing, the slab is hotrolled to a thickness of 10 mm and is descaled, pickled and flatrolled to a final thickness of 3.2 mm. The sheet thus produced can be directly coldrolled or coldrolled after annealing to any desired thickness down to 0.01 mm.

EXAMPLE 2

A nickel alloy having an oxygen level brought to 0.09% by weight, balance nickel, is cast into an ingot having an average cross-section of 410 × 750 mm with a weight of about 4.2 metric tons. After hotrolling from a temperature of 1100° C to a temperature of 800° C in the first heat to a slab of a thickness of 160 mm, the composition is rolled in further hotrolling steps to a thickness of 5 mm. Finally, the product is rolled in several steps to an ultimate thickness of 0.5 mm by coldrolling. In this case as well an unobjectionable working of the sheet was obtained.

In both cases, lattice analyses were carried out and it was found that in the first stage of each, there had been complete destruction of the nickel/nickel-oxide eutectic with the nickel oxide being distributed uniformly throughout the total lattice structure in finely divided form.

BRIEF DESCRIPTION OF THE DRAWING

The above and other objects of the invention will become apparent from the following description, reference being made to the accompanying drawing in which.

SPECIFIC DESCRIPTION

Figure 1:
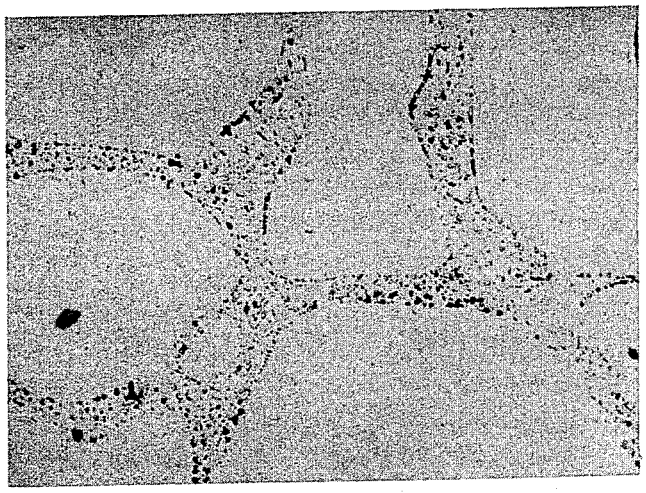
FIG. 1 is a photomicrograph of the lattice structure of the nickel composition prior to the breakdown of the nickel/nickel-oxide eutectic.

In the drawing, FIG. 1 shows a photomicrograph of a portion of an ingot containing 0.4% by weight nickel oxide and enlarged 500:1. In the photomicrograph the greyish areas correspond to the nickel/nickel-oxide eutectic while the white areas correspond to the nickel matrix.

Figure 2:
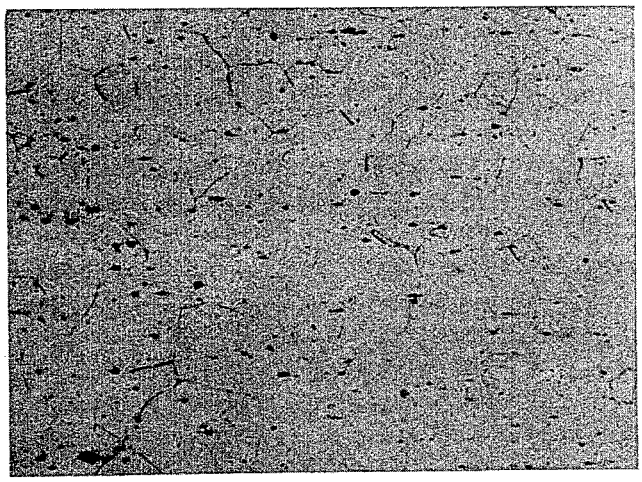
FIG. 2 is a similar view subsequent to the distribution of the nickel oxide in the lattice structure.

In FIG. 2 we have shown the ingot after it has been subjected to treatment according to the invention.

This treatment consisted of the following:

(a) Hotrolling of the ingot at a temperature of 1100° C to 800° C to a thickness of 3 mm;

(b) quenching the ingot from a temperature of 800° C to 750° C to room temperature in water;

(c) coldrolling the quenched product to 0.10 mm thickness; and (d) annealing the sheet for 3 hours at 500° C. The dark points show the nickel oxide inclusions finely divided uniformly throughout the matrix or lattice of the nickel.

While similar lattice structures are obtained without the quenching step, we have found that the quenching step greatly improves the coldformability and the notch-breaking test results. With the quenching step, the oxygen level can be at the upper end of the range set forth above without any disadvantages, even when higher temperatures are used in the hotworking of the melt. It is indeed surprising that the quenching step can permit such high oxygen levels in a nickel melt since it has been shown in the literature (see the phase diagram at page 1025 of CONSTITUTION OF BINARY ALLOYS, McGraw-Hill Book Company, Inc., New York, 1958) that at 600° C 0.073 atomic percent of oxygen can be dissolved in nickel whereas at 1200° C, only 0.044 atomic percent oxygen is so soluble. The quenching step appears to retain more oxygen as finely divided nickel oxide in the lattice structure and enables more of this nickel oxide to be dispersed at the lattice boundaries.

In the case of the nickel composition illustrated in the drawing, the notch test gives a value at 750° C of 26 m/kg per $cm^2$ for the composition subjected to quenching while the value is 15 m/kg per $cm^2$ in the case of slow cooling.

The system of the present invention also has the advantage that it is possible to roll the nickel compositions to thicknesses of about 0.01 mm or thicknesses corresponding to foils without pore formation and striping, both of which occur with nickel compositions deoxidized in the conventional manner.

When foreign oxides are present and nickel rolled into foiled thicknesses, it is found that the oxide inclusions have different thermal expansion coefficients than the lattice metal and result in the formation of fine cracks in which molecular hydrogen tends to collect. Such effects result in greater splitting of the material so that, in practice, up to 80% of conventional nickel compositions of foil thicknesses must be discarded.

With the system of the present invention, however, the highly dispersed state of the nickel oxide excludes such expansion and contraction differences presumably because with increasing temperature the nickel oxide expands by picking up additional oxygen from the atmosphere and hence to release the additional oxygen upon cooling, thereby compensating for what otherwise would be a difference in thermal expansion and contraction coefficients. As a result, foils of a thickness of 0.01 mm are completely smooth and porefree and can be produced without any significant amount of rejects.

We claim:

1. A process for producing a workable nickel composition, said process comprising the steps of:

(a) forming a melt consisting of 0.01 to 0.15% by weight oxygen, the balance nickel;

(b) casting said melt to form an ingot containing said oxygen in the form of nickel oxide, at least part of the nickel oxide being present as a nickel/nickel-oxide eutectic; and (c) hotforming said ingot to destroy the nickel/nickel-oxide eutectic thereof and finely distribute the nickel oxide uniformly in the metallic lattice structure of the hot-formed body.

2. The process defined in claim 1 wherein said melt is formed with 0.02 to 0.12% by weight oxygen.

3. The process defined in claim 1 wherein the hotforming is carried out at a temperature between 1150° C and 750° C.

4. The process defined in claim 3, further comprising the step of:

cold forming the product formed by the hotforming.

5. The process defined in claim 4, further comprising the step of:

annealing the product produced by hotforming before it is subjected to coldforming.

6. The process defined in claim 4, further comprising the step of:

annealing the coldformed product.

7. The process defined in claim 4, further comprising the step of:

quenching the hotformed product prior to the further forming thereof.

8. The process defined in claim 4 wherein the hotforming is carried out by roller.

9. The product made by the process of claim 1.

* * * * *